US009474393B2

(12) United States Patent
Denby et al.

(10) Patent No.: US 9,474,393 B2
(45) Date of Patent: Oct. 25, 2016

(54) MATTRESS DISPLAY FIXTURE

(71) Applicant: TARGET BRANDS INC., Minneapolis, MN (US)

(72) Inventors: Scott E. Denby, Minneapolis, MN (US); Nick Angvall, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 36 days.

(21) Appl. No.: 14/323,319

(22) Filed: Jul. 3, 2014

(65) Prior Publication Data

US 2016/0000239 A1 Jan. 7, 2016

(51) Int. Cl.

| | |
|---|---|
| ***A47F 7/30*** | (2006.01) |
| ***A47B 57/10*** | (2006.01) |
| ***A47B 96/02*** | (2006.01) |

(52) U.S. Cl.

CPC ..... *A47F 7/30* (2013.01); *A47B 57/10* (2013.01); *A47B 96/027* (2013.01)

(58) Field of Classification Search

CPC .... A47B 47/022; A47B 57/06; A47B 57/08; A47B 57/10; A47B 96/027; A47F 7/30

See application file for complete search history.

(56) References Cited

U.S. PATENT DOCUMENTS

| | | | | |
|---|---|---|---|---|
| 288,616 A | | 11/1883 | Boynton et al. | |
| 291,030 A | * | 1/1884 | Clapper | A47B 57/04 108/1 |
| 479,894 A | | 8/1892 | Moore | |
| 680,965 A | * | 8/1901 | Distelhurst | A47F 7/30 211/126.14 |
| 909,336 A | * | 1/1909 | Riedy | A47F 7/30 108/106 |
| 1,019,983 A | | 3/1912 | McGaughey | |
| 1,020,331 A | | 3/1912 | Taylor | |
| 1,071,671 A | | 8/1913 | McGurdy | |
| 1,114,455 A | | 10/1914 | Fisher | |
| 1,373,781 A | | 4/1921 | Wagner | |
| 1,585,937 A | | 5/1926 | Paul | |

(Continued)

FOREIGN PATENT DOCUMENTS

| | | | | |
|---|---|---|---|---|
| ES | EP 2638830 A1 | * | 9/2013 | A47F 7/30 |
| FR | 931418 A | * | 2/1948 | A47B 57/08 |

(Continued)

OTHER PUBLICATIONS

Jaken Cantilever Rack, found online at http://www.cssyes.com/PDF/Jaken-Brochure/Heavy-Duty-Cantilever-Rack-619-255-1428.pdf, available at least as of May 27, 2014, 3 pages.

(Continued)

*Primary Examiner* — Stanton L Krycinski
(74) *Attorney, Agent, or Firm* — JoAnn M. Seaton; Griffiths & Seaton PLLC

(57) ABSTRACT

A mattress display fixture that supports a plurality of horizontally oriented mattresses in a vertically stacked arrangement on shelves, with the mattresses vertically spaced from one another, for display to customers. The shelves of the display fixture are cantilever supported, with each shelf being of sufficient size to accommodate a mattress thereon. Each shelf slopes downwardly from a front side to a rear side thereof such that the front side is disposed at a vertical height greater than the rear side. The construction of the display fixture is such that it adequately supports the mattresses, yet is of minimal construction to minimize its aesthetic intrusion on the mattresses so that the customer's focus is primarily on the mattresses and not on the display fixture.

18 Claims, 7 Drawing Sheets

(56) References Cited

U.S. PATENT DOCUMENTS

| | | | | |
|---|---|---|---|---|
| 1,605,285 | A | 11/1926 | Rouse et al. | |
| 1,716,862 | A * | 6/1929 | McEntire | A47F 7/30 211/181.1 |
| D118,442 | S | 1/1940 | Brown | |
| 2,713,424 | A * | 7/1955 | Thompson | A47F 7/30 211/27 |
| 3,280,989 | A | 10/1966 | Melvin et al. | |
| 3,357,569 | A | 12/1967 | Goodman et al. | |
| D221,703 | S | 8/1971 | Fleming | |
| 4,023,682 | A | 5/1977 | Niece | |
| D246,593 | S | 12/1977 | Paquette | |
| 4,233,912 | A * | 11/1980 | Ferdinand | A47B 57/10 108/109 |
| 4,410,093 | A | 10/1983 | Chiariello et al. | |
| D288,266 | S | 2/1987 | Campbell | |
| 4,678,085 | A | 7/1987 | Sando | |
| 4,705,178 | A | 11/1987 | Vail, Sr. et al. | |
| 4,757,906 | A | 7/1988 | Ovitz, III | |
| D297,489 | S | 9/1988 | Chap et al. | |
| 4,895,381 | A * | 1/1990 | Farlow | A47F 7/30 108/106 |
| 5,022,540 | A | 6/1991 | Vail, Sr. et al. | |
| 5,074,422 | A * | 12/1991 | Holtz | A47B 57/10 108/108 |
| 5,111,940 | A | 5/1992 | VanNoord | |
| D329,903 | S | 9/1992 | Craig | |
| D329,954 | S | 10/1992 | Sharon et al. | |
| 5,564,346 | A * | 10/1996 | Robben | A47B 9/00 108/108 |
| 5,641,083 | A | 6/1997 | Metcalf | |
| D383,335 | S | 9/1997 | Shanahan et al. | |
| 5,722,623 | A * | 3/1998 | Gibson | G09F 3/204 248/201 |
| D421,062 | S | 2/2000 | Goodman et al. | |
| D421,273 | S | 2/2000 | Goodman et al. | |
| D421,351 | S | 3/2000 | Kopala, Jr. | |
| 6,062,401 | A * | 5/2000 | Hall | A47B 87/0246 108/144.11 |
| D437,710 | S | 2/2001 | Guerra et al. | |
| 6,302,036 | B1 | 10/2001 | Carson et al. | |
| D489,096 | S | 4/2004 | Chen | |
| D534,374 | S | 1/2007 | Wright | |
| 7,246,711 | B1 | 7/2007 | Metcalf | |
| D571,578 | S | 6/2008 | Ferrari | |
| 7,494,019 | B2 * | 2/2009 | Kessell | A47B 57/06 108/108 |
| D613,965 | S | 4/2010 | Tertel et al. | |
| 7,806,283 | B2 | 10/2010 | Metcalf | |
| D668,889 | S | 10/2012 | Theisen | |
| 8,286,808 | B1 | 10/2012 | Setlik | |
| D690,540 | S | 10/2013 | Dryden | |
| D704,483 | S | 5/2014 | Dryden | |
| D717,371 | S | 11/2014 | Tsai | |
| D719,610 | S | 12/2014 | Tsai | |
| D723,141 | S | 2/2015 | Furuno et al. | |
| D750,921 | S | 3/2016 | Kozak | |
| 2001/0009639 | A1 * | 7/2001 | Gunn | A47B 57/10 414/286 |
| 2007/0200035 | A1 | 8/2007 | Chamberlain, III et al. | |
| 2009/0065452 | A1 | 3/2009 | Smith | |
| 2009/0065453 | A1 | 3/2009 | Smith | |
| 2011/0187244 | A1 | 8/2011 | Schachte | |
| 2013/0125435 | A1 | 5/2013 | Keever | |
| 2013/0318715 | A1 | 12/2013 | Ross | |
| 2014/0144808 | A1 | 5/2014 | Anderson | |
| 2014/0263125 | A1 * | 9/2014 | Gonzalez | A47B 96/1408 211/134 |
| 2016/0000239 | A1 | 1/2016 | Denby et al. | |

FOREIGN PATENT DOCUMENTS

| | | | | |
|---|---|---|---|---|
| FR | 1501475 | A * | 11/1967 | A47B 57/10 |
| FR | 2682577 | A1 * | 4/1993 | A47B 57/10 |
| FR | WO 9518556 | A1 * | 7/1995 | A47B 47/0066 |
| FR | 2721814 | A1 * | 1/1996 | A47B 57/10 |
| FR | 2862504 | A1 * | 5/2005 | A47B 57/04 |

OTHER PUBLICATIONS

Jarke Button-On Cantilever Rack Components, found online at http://www.industrialsupplies.com/storage-solutions/racks/d-152070-152070-191360, available at least as of May 27, 2014, 3 pages.

EC Retail Studio Bedding/Furniture Fixture Offerings, found online at http://www.ecretailstudio.com/fixtures.html, available at least as of Oct. 16, 2013, 2 pages.

Photograph of pillow center by Wright Global Graphic Solutions, found online at http://www.wrightglobalgraphics.com/slides-retail.html, available at least as of Oct. 16, 2013, 1 page.

Photograph of sleep center by Wright Global Graphic Solutions, found online at http://www.wrigatalobalaraphics.com/slides-retail.html, available at least as of Oct. 16, 2013, 1 page.

* cited by examiner

MATTRESS DISPLAY FIXTURE

BACKGROUND

Display fixtures in a retail store organize and present products or merchandise to customers for purchase. Mattresses are one example of a type of product that can be presented in retail stores for purchase. It is desirable to display the mattresses in a manner that is uncluttered so that the focus of the customer is on the displayed mattresses and not on the display fixture.

SUMMARY

A mattress display fixture is described that supports a plurality of horizontally oriented mattresses in a vertically stacked arrangement on shelves, with the mattresses vertically spaced from one another, for display to customers. The construction of the display fixture is such that it adequately supports the mattresses, yet is of minimal construction to minimize its aesthetic intrusion on the mattresses so that the customer's focus is primarily on the mattresses and not on the display fixture.

In one embodiment, the shelves of the display fixture are cantilever supported, with each shelf being of sufficient size to accommodate a mattress thereon. Each shelf slopes downwardly from a front side to a rear side thereof such that the front side is disposed at a vertical height greater than the rear side.

In another embodiment, each shelf can be supported at first locations by first portions of first and second vertically extending support members and supported at second locations by second portions of the first and second vertically extending support members, where the second portions are positioned forwardly of the first portions.

The display fixture can include a pair of vertically extending support members or support means spaced apart from one another, with each of the support members including an upper end and a lower end, a plurality of cut-outs formed therein and vertically spaced from one another between the upper end and the lower end, and a plurality of horizontally extending support beams integrally formed therewith at positions forwardly of and spaced from the cut-outs. Each cut-out includes at least one of the support beams associated therewith. The vertically spaced shelves are removably attached to the vertical support members and cantilever supported therefrom so that the shelves extend forwardly from the vertical support members. Each shelf includes a rear side removably disposed within a respective one of the cut-outs and a front side opposite the rear side, and each shelf includes a portion that is located forwardly of the rear side that is supported on one of the support beams.

DRAWINGS

DETAILED DESCRIPTION

A mattress display fixture is described that supports a plurality of horizontally oriented mattresses in a vertically stacked arrangement on shelves, with the mattresses vertically spaced from one another, for display to customers. In one embodiment, the shelves of the display fixture can be cantilever supported, with each shelf being of sufficient size to accommodate a mattress thereon. In one embodiment, each shelf can slope downwardly from a front side to a rear side thereof such that the front side is disposed at a vertical height greater than the rear side. In addition, the shelves are configured to provide full support of the mattresses, yet allow the mattresses to be relatively easily pulled out of and slid into the shelves since the support surface formed by the shelves is not continuous thereby reducing friction between the mattresses and the shelves.

In an embodiment, the display fixture can include a pair of vertically extending support members or support means spaced apart from one another, with each of the support members including a plurality of cut-outs formed therein and a plurality of horizontally extending support beams at positions forwardly of and spaced from the cut-outs. The shelves are removably attached to the vertical support members and cantilever supported therefrom so that the shelves extend forwardly from the vertical support members. Each shelf includes a rear side removably disposed within a respective one of the cut-outs and a front side opposite the rear side, and each shelf includes a portion that is located forwardly of the rear side that is supported on one of the support beams.

An embodiment of the mattress display fixture 10 in an assembled state is illustrated in FIGS. 1-6. The fixture 10 includes first and second vertically extending support members or support means 12*a*, 12*b*, and a plurality of shelves 14 detachably attached to the support members 12*a*, 12*b* and cantilever supported therefrom. The number of shelves 14 in the fixture 10 is arbitrary and can be any desired number. In the illustrated example, there are six shelves 14 although a larger or smaller number of shelves can be provided.

The shelves 14 are considered cantilever supported since each shelf 14 is fixed or anchored at only one side to the support members 12*a*, 12*b*, and except for the support members 12*a*, 12*b*, there is no other structure that supports the shelves 14. The shelves are supported only at or adjacent to their rear or back sides, with at least the forward half of each shelf unsupported by support structure.

Figure 3:
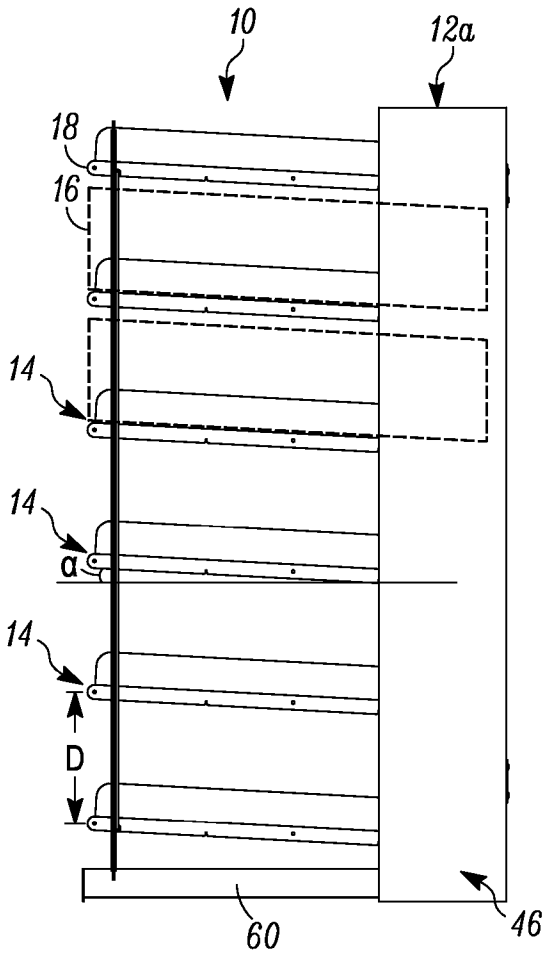
FIG. 3 is a right side view of the mattress display fixture of FIG. 1. The left side view is identical to FIG. 3 except for the elements 80, 82.

With reference to FIG. 3, which is a side view of the fixture 10, each shelf 14 is of sufficient size to accommodate a mattress 16 thereon (only two mattresses 16 are depicted in dashed lines in FIG. 3). The mattresses 16 can be any size such as king, queen, full, twin or the like, and can have any desired construction. In addition, the term "mattress" as used herein is intended to encompass box springs.

The shelves 14 are vertically spaced apart from each other a sufficient distance to accommodate the thickness of each mattress 16, and the shelves 14 extend forwardly from the support members 12*a*, 12*b*. In one embodiment, the shelves 14 are vertically spaced apart from each other by a first, fixed vertical distance D, measured from a front side of one shelf 14 to the front side of another shelf 14 as depicted in FIG. 3, which is greater than the thickness of the mattresses 16 to be supported. In one embodiment, the distance D is constant from the front side of the shelves 14 to a rear side of the shelves 14. The distance D can vary based on the mattress thickness. In addition, the distance D need not be the same for each shelf 14 of the fixture 10. Instead, within the fixture 10, the distance D can vary between the shelves 14 if the fixture supports mattresses 16 having different thicknesses.

Figure 1:
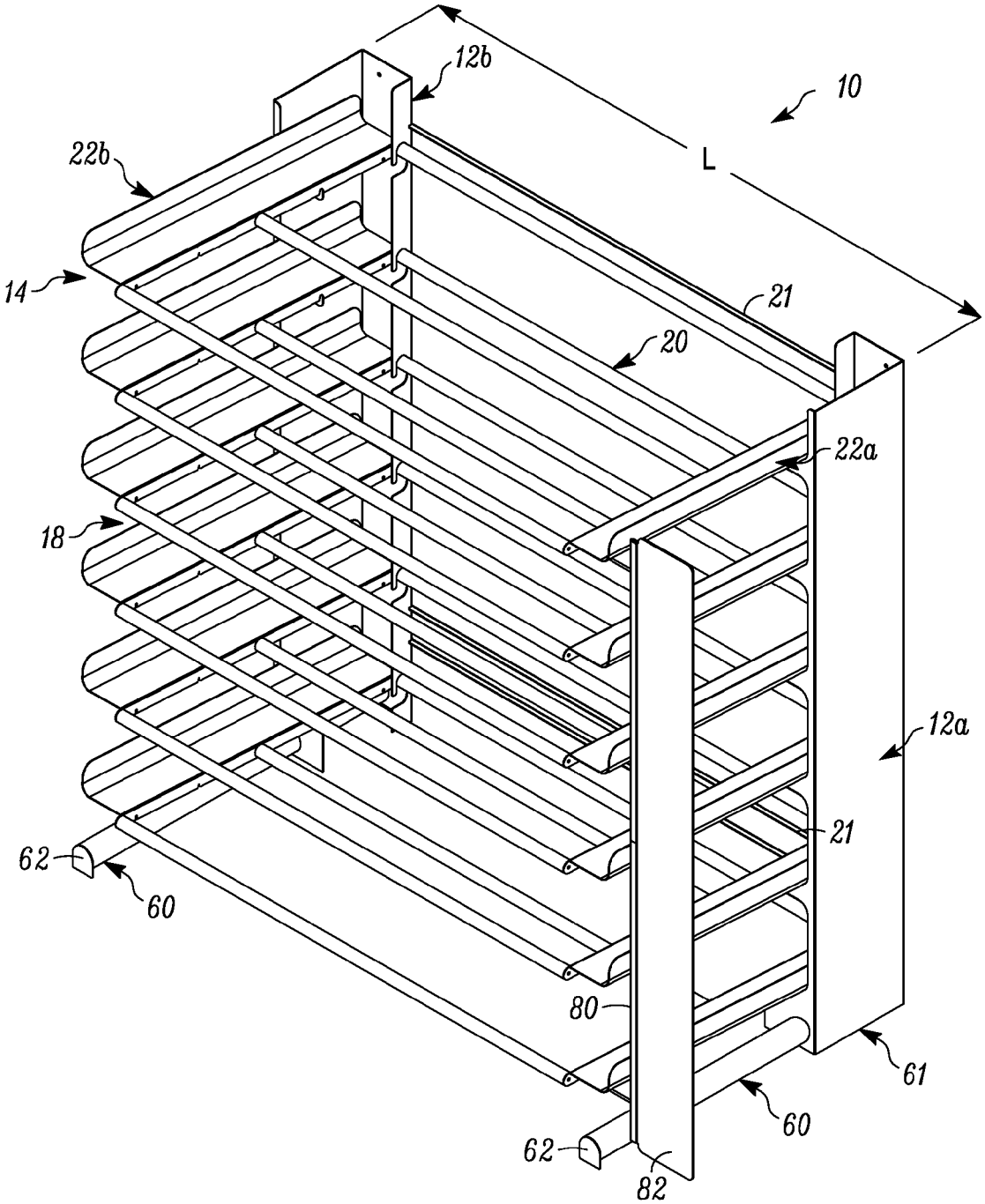
FIG. 1 is a perspective view of an embodiment of the mattress display fixture described herein.

With reference to FIGS. 1 and 3, each shelf 14 is supported on the fixture 10 to slope downwardly at an angle $\alpha$ measured from a horizontal axis from a front (or second) side 18 thereof to a rear (or first) side 20 (seen in FIGS. 1 and 7) thereof such that the front side 18 is disposed at a vertical height greater than the rear side 20. The downward slope of the shelves 14 helps to retain the mattresses 16 on the shelves 14. The specific slope angle $\alpha$ is not critical as long as a downward slope is provided to help retain the mattresses 16 on the shelves 14.

Figure 5:
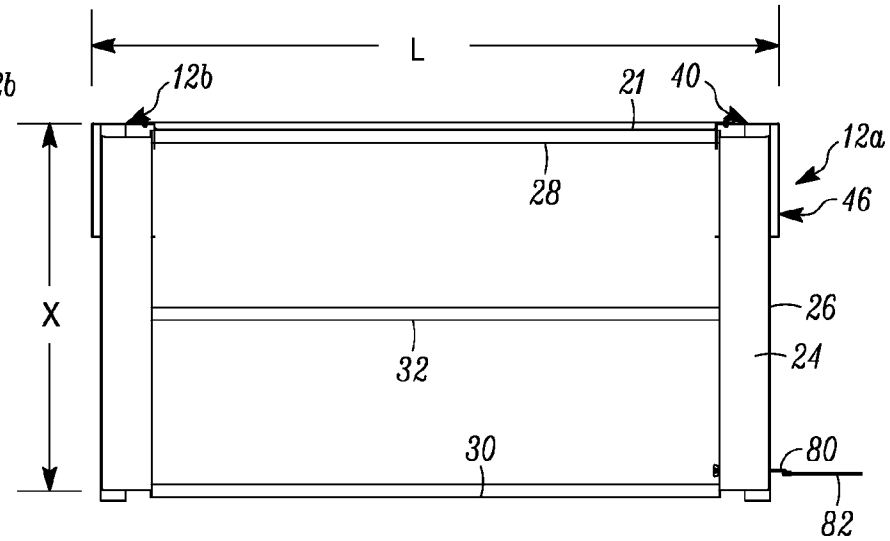
FIG. 5 is a top view of the mattress display fixture of FIG. 1.
Figure 4:
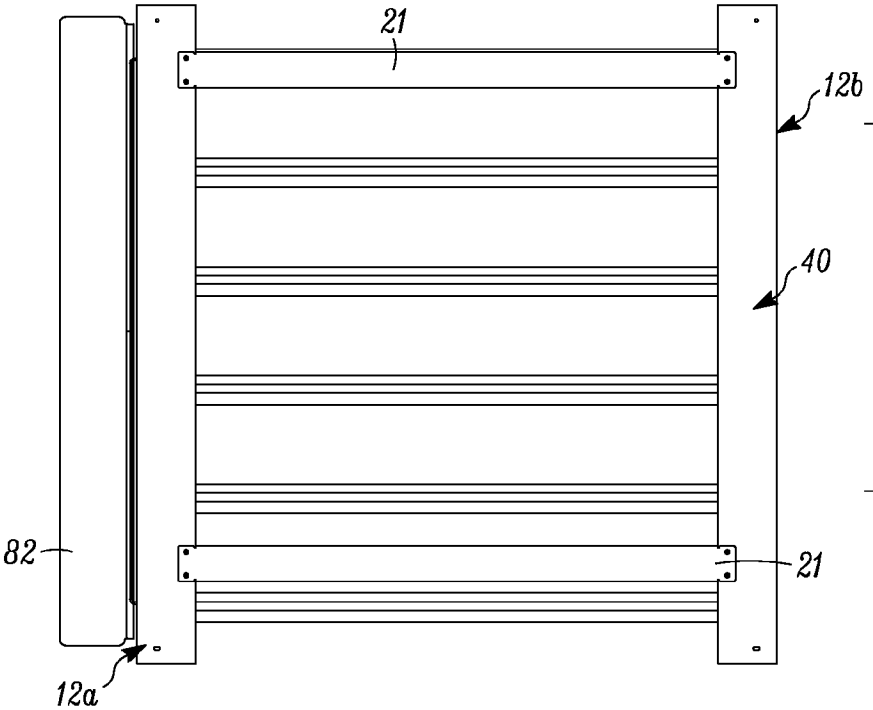
FIG. 4 is a rear view of the mattress display fixture of FIG. 1.
Figure 6:
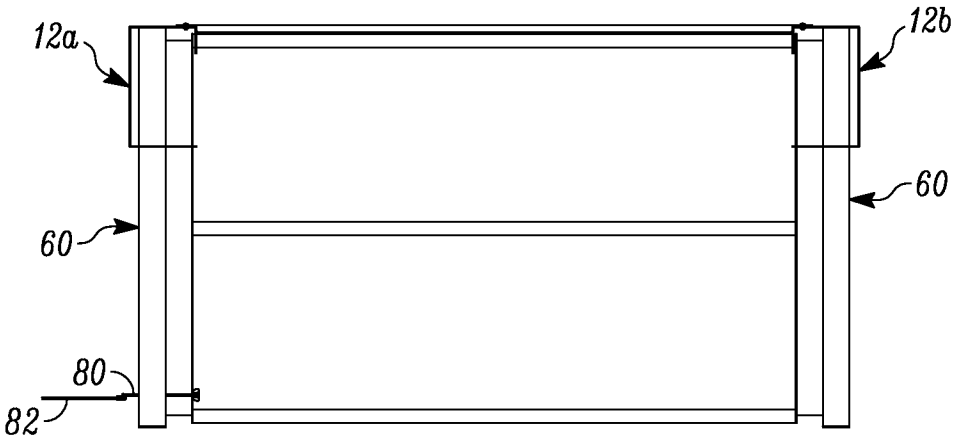
FIG. 6 is a bottom view of the mattress display fixture of FIG. 1.

With reference to FIGS. 1 and 5, the support members 12*a*, 12*b* are spaced apart from one another by a fixed horizontal, straight-line distance L measured from the outer surface of each support member 12*a*, 12*b*. The support members 12*a*, 12*b* can be kept spaced apart from each other by one or more spacer members 21 (FIGS. 1 and 4) that extend between and are fixed to the support members 12*a*, 12*b*. In addition, in the top view of FIG. 5, a straight-line distance measured between the front side and the rear side of the shelves is X; i.e. in other words, each shelf 14 extends forwardly approximately the distance X.

In the illustrated embodiment, the distance L is greater than the distance X, and the mattresses 16 are oriented on the shelves 14 such that the longer side of each mattress 16 is parallel to the distance L, and the shorter side of each mattress 16 is parallel to the distance X. However, the display fixture can be constructed such that the distance X is greater than the distance L, and the mattresses 16 can be oriented such that the longer side of each mattress 16 is parallel to the distance X, and the shorter side of each mattress 16 is parallel to the distance L. In other embodiments, for example for substantially square mattresses 16, the distance L can be approximately equal to the distance X. As seen in FIGS. 3 and 5, in one embodiment the distance X can be such that the front edges of the mattresses 16 do not, or only minimally, extend beyond the front sides 18 of the shelves 14.

Figure 7:
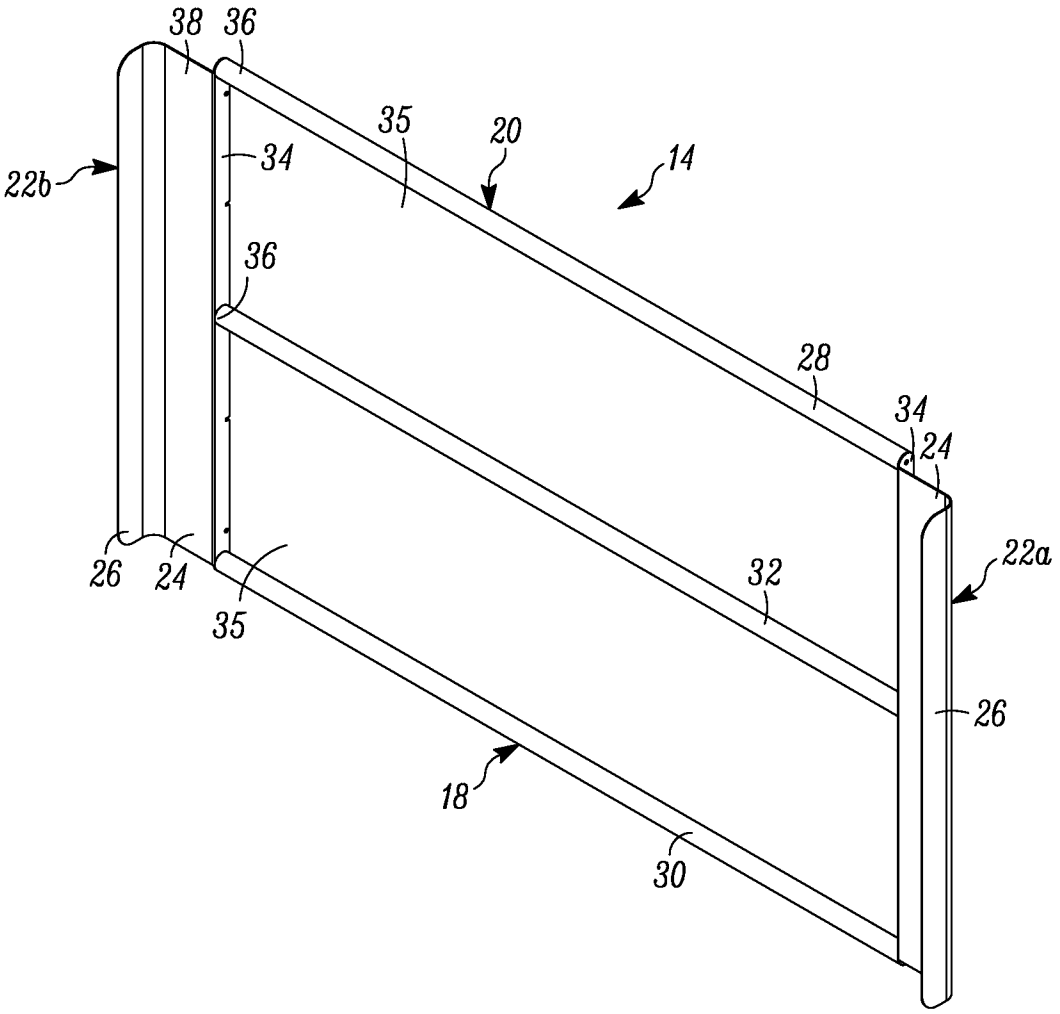
FIG. 7 is a perspective view of one of the shelves of the mattress display fixture.

Referring to FIGS. 1-6 together with FIG. 7 which is a perspective view of one of the shelves removed from the support members 12*a*, 12*b*, each shelf 14 is configured to provide full support of the mattress 16 disposed thereon, yet is formed as a discontinuous structure to reduce friction between the mattress 16 and the shelf 14 to allow the mattress 16 to be relatively easily pulled out of and slid onto the shelf 14.

In the illustrated example, each shelf 14 includes first and second L-shaped members 22*a*, 22*b* that are spaced apart from one another by approximately the distance L. The L-shaped members 22*a*, 22*b* are identical in construction to each other, with each L-shaped member 22*a*, 22*b* including a substantially solid and continuous horizontal leg portion 24 and a substantially solid and continuous vertical base portion 26. The L-shaped members 22*a*, 22*b* are oriented relative to each other so that the leg portions 24 extend toward one another with the base portions 26 extending vertically upward. In this orientation, the leg portions 24 are positioned to support opposite lower sides of the mattress 16 while the base portions 26 limit side-to-side movements of the mattress 16 when disposed on the shelf 14. The base portions 26 may also act as guides when loading a mattress onto the shelf 14.

Each shelf 14 further includes a plurality of spacers that are fixed to the L-shaped members 22*a*, 22*b* to space the L-shaped members 22*a*, 22*b* from one another and that support an intermediate portion of the mattress 14. In the illustrated example, the spacers include a rear spacer 28, a front spacer 30, and an intermediate spacer 32 between the rear spacer 28 and the front spacer 30. Although each shelf 14 is illustrated and described as having three spacers 28, 30, 32, a larger or smaller number of spacers can be used.

The spacers 28, 30, 32 are fixed at their ends to and extend between flanges 34 that extend vertically downward from the leg portions 24 of the L-shaped members 22*a*, 22*b*. As evident from FIG. 7, the rear spacer 28, the front spacer 30, and the intermediate spacer 32 are parallel to one another, and spaced from one another with gaps or spaces 35 therebetween to form a discontinuous support surface. The spacers 28, 30, 32 also extend parallel to the spacer members 21. In addition, an upper surface 36 of each spacer is approximately flush with upper surfaces 38 of the leg portions 24 which form continuous support surfaces. In the illustrated example, the spacers 28, 30, 32 are generally cylindrical rods. However, the spacers 28, 30, 32 can have any shape and construction that permits the spacers 28, 30, 32 to perform their functions.

This construction of the shelves 14 provides for full support of the mattresses 16, with the upper surfaces 38 of the leg portions 24 supporting end edges of the mattresses and the upper surfaces 36 of the spacers 28, 30, 32 supporting the intermediate portions of the mattresses 16. However, since the intermediate portions of the mattresses are supported only by the upper surfaces 36 of the spacers 28, 30, 32, and are not supported in the gaps 35 between the spacers 28, 30, 32, there is reduced friction between the mattresses 16 and the shelves 14 which allows the mattresses 16 to be relatively easily pulled out of and slid onto the shelves 14. Further, since the upper surfaces 36 of the spacers 28, 30, 32 are substantially flush with the upper surfaces 38 of the leg portions, the mattresses are supported on a generally smooth support surface.

Referring now to FIGS. 8-11 together with FIGS. 1-6, the vertically extending support members 12*a*, 12*b* are identical in construction. In the illustrated example, each support member 12*a*, 12*b* is formed as an integral, single-piece, unitary construction.

As discussed in further detail below, each support member 12*a*, 12*b* defines a pair of support structures that support each shelf 14, including a plurality of rear support structures and a plurality of forward support structures located forwardly of the rear support structures. Each of the rear support structures is configured to removably receive therein a rear portion of one of the shelves 14, and each of the forward support structures is configured to removably support thereon an intermediate portion of one of the shelves. With this construction, each shelf 14 is supported at two spaced locations by each of the support members 12*a*, 12*b*.

The support members 12*a*, 12*b* can have any construction that provides the two separate support locations.

Figure 8:
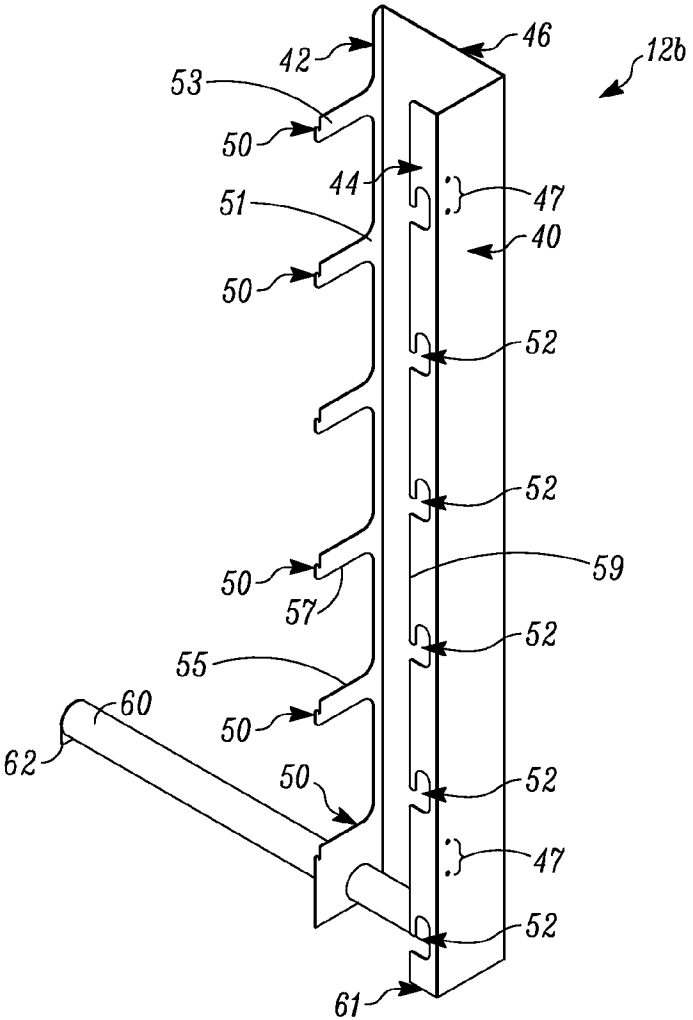
FIG. 8 is a rear perspective view of one of the vertically extending support members of the mattress display fixture.

In the embodiment illustrated in FIGS. 8-11, each of the support members 12*a*, 12*b* includes a rear panel 40, a front panel 42, an interior side panel 44, and an exterior side panel 46. The rear panel 40 forms a rearward surface of the support member 12*a*, 12*b* and is disposed in a plane that is generally parallel to the spacer members 21 and parallel to the axes of the spacers 28, 30, 32. In the illustrated example, the rear panel 40 is substantially rectangular with few or no apertures or cut-outs formed therein. However, as seen in FIG. 8, the rear panel 40 includes mounting apertures 47 that are used to secure the ends of the spacer members 21 to the rear panels 40 using fasteners such as bolts, screws, rivets or the like (see FIG. 4).

As best seen in FIGS. 8-11, the front panel 42 is spaced from the rear panel 40 and extends parallel thereto. The front panel 42 is a partial panel and includes a plurality of vertically spaced, horizontal support beams 50 that extend generally parallel to the plane of the rear panel 40 and each of which supports a corresponding one of the shelves 14. Each support beam 50 includes a connected end 51 and a free or unconnected end 53, an upper surface 55 on which bottom surfaces of the leg portions 24 of the shelves 14 rest to support the shelves 14, and a lower surface 57 opposite to the upper surface 55. The support beams 50 form a plurality of forward support structures that support intermediate portions of the shelves 14 forwardly of rear portions of the shelves 14 that are supported by a different portion of the support members 12*a*, 12*b*.

Figure 10:
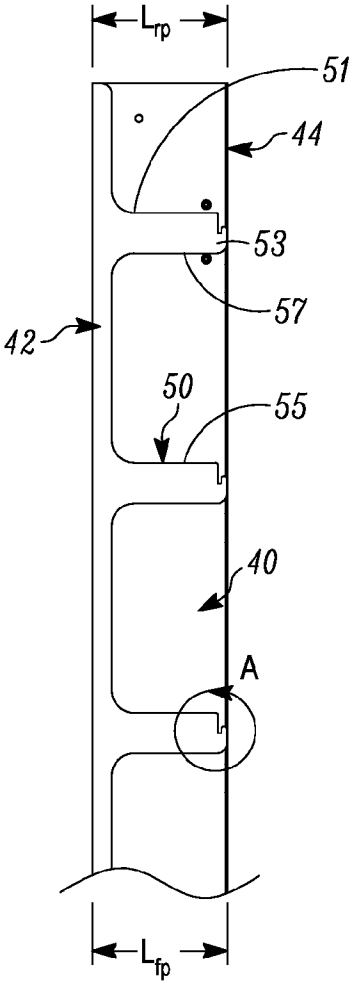
FIG. 10 is a front view of a portion of the vertically extending support member of FIG. 8.

As best seen in FIG. 10, the front panel 42 including the support beams 50 has a length $L_{fp}$ extending from the exterior side panel 46 that is approximately equal to the length $L_{rp}$ of the rear panel 40 so that the ends 53 of the support beams 50 are generally flush with and generally do not extend beyond the plane of the interior side panel 44.

Figure 9:
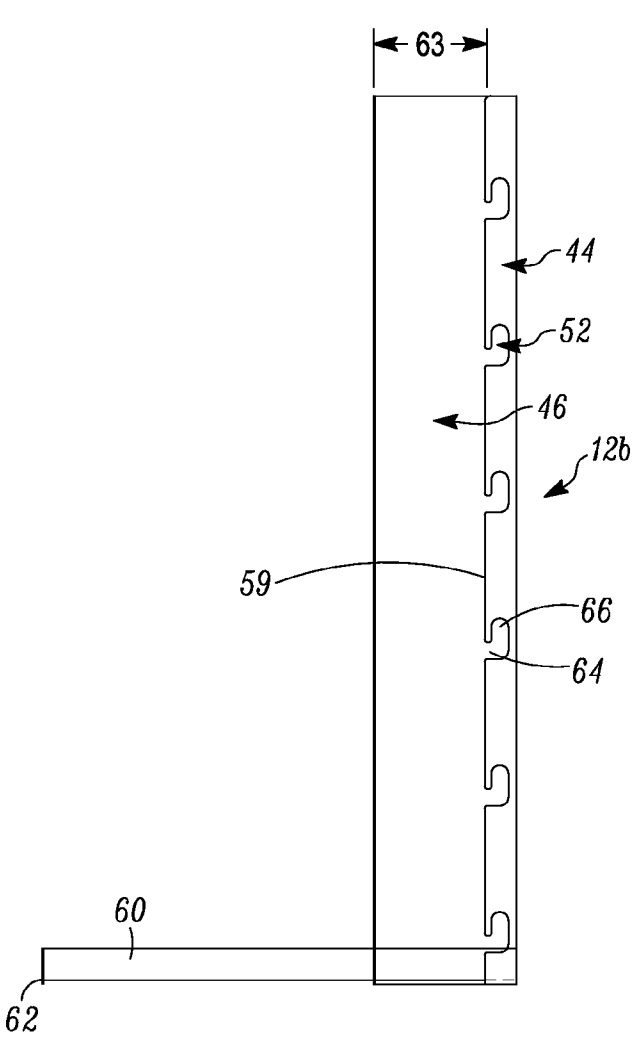
FIG. 9 is an inner side view of the vertically extending support member of FIG. 8.

As best seen in FIGS. 8 and 9, the interior side panel 44 extends forwardly from the rear panel 40 generally parallel to the exterior side panel 46. The interior side panel 44 extends toward the free ends 53 of the support beams 50 to a front edge 59 thereof. The front edge 59 is spaced from the ends 53 of the beams 50 to define a gap 63 therebetween.

The interior side panel 44 is a partial wall that includes a plurality of vertically spaced, L-shaped cut-outs 52, each of which removably receives therein the rear spacer 28 of the first side 20 of one of the shelves 14. Each cut-out 52 includes a generally horizontal portion 64 that opens through the front edge 59 of the interior side panel 44 and a generally vertical portion 66 extending upwardly from the horizontal portion 64. The horizontal portion 64 and the vertical portion 66 of each of the cut-outs 52 form a generally L-shape. The cutouts 52 form a plurality of rear support structures that are configured to removably receive therein rear portions, such as the rear spacers 28, of the shelves 14.

In one embodiment, the number of the support beams 50 equals the number of the L-shaped cut-outs 52 which in turn equals the number of the shelves 14, and each one of the support beams 50 is associated with a corresponding one of the L-shaped cut-outs 52. In the illustrated embodiment, there are six shelves 14, and six of the support beams 50 and six of the cut-outs 52 on each support member 12*a*, 12*b*. However, a larger or smaller number of shelves 14 can be used. The support beams 50 are spaced forwardly of the cut-outs 52 by a distance that is approximately equal to the gap 63, or by a distance that is slightly less than the length of the exterior side panel 46.

The exterior side panel 46 extends between and is connected to the rear panel 40 and the front panel 42, and is parallel to the interior side panel 44. The panel 46 is substantially rectangular with few or no apertures or cut-outs formed therein and forms an L-shape with the rear panel 40.

Figure 11:
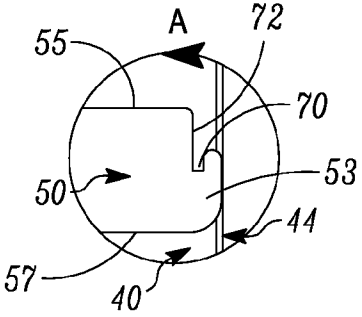
FIG. 11 is a close-up view of the portion of a support beam of the vertically extending support member contained in the circle A in FIG. 10.

With reference to FIGS. 1 and 11, the free end 53 of each support beam 50 is formed with an upwardly facing slot 70 and a shoulder 72. In use, as discussed further below, the leg portions 24 of the shelves 14 rest on and are supported by the upper surfaces 55 of the support beams 50, with the flanges 34 of the shelves fitting within the slots 70 of the support beams 50 so that the flanges 34 are disposed adjacent to the shoulders 72. The flanges 34 fitting within the slots 70, together with the shoulders 72, help to prevent side-to-side shifting of the shelves 14 on the support beams 50.

With the construction described above, each of the support members 12*a*, 12*b* forms a generally rectangular shape defining an open interior space and that is open at its interior side due to the gap 63 because the interior side panel 44 does not extend all the way to the front panel 42.

In addition, as best seen in FIGS. 1, 8 and 9, a support arm 60 is connected to a floor engaging base end 61 of each of the support members 12*a*, 12*b*. Each support arm 60 extends forwardly from the support members 12*a*, 12*b*, and each support arm 60 has a length that is approximately equal to the length of each shelf 14 measured between the first side 18 and the second side 20, or approximately equal to the distance X (see FIG. 5).

The support arms 60 are configured to engage the floor to help support the display fixture 10 on the floor and help stabilize the fixture 10 together with the floor engaging ends 61 of the support members 12*a*, 12*b*. In the illustrated example, the support arms 60 include a front end plate 62 (see FIGS. 1, 8 and 9) that contacts the floor along with the ends 61 of the support members 12*a*, 12*b* to stabilize the fixture 10 during use. In addition, the support arms 60 extend through the lowermost support beam 50 of each support member 12*a*, 12*b* and are suitably fixed to the support members 12*a*, 12*b* for example by welding or using mechanical fasteners.

Figure 2:
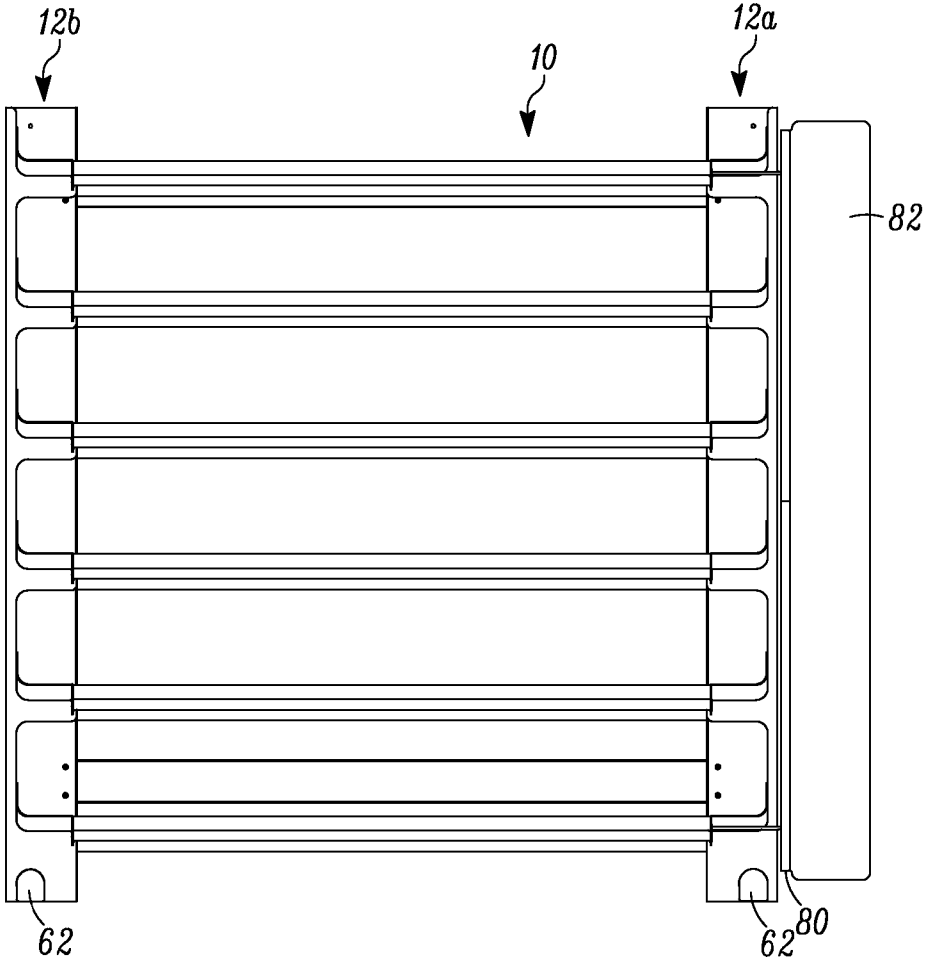
FIG. 2 is a front view of the mattress display fixture of FIG. 1.

Referring to FIGS. 1-3 and 5, an optional sign support 80 is fixed to outside surfaces of a plurality of the base portions 26 of one of the L-shaped members 22*a*, 22*b* of the shelves 14 adjacent to the front side of the shelves. For example, as depicted in FIGS. 1 and 2, the sign support 80 can be fixed to the right side L-shaped member 22*a* when facing the display fixture 10. The sign support 80 can also be installed on the left side of the fixture as well in a similar manner. The sign support 80 comprises a rod or bar that extends generally vertically and is suitably fixed to the shelves 14, and a forwardly facing surface 82 connected to the sign support 80 on which promotional material for the mattresses 16, for example brand information, prices, and the like, can be positioned for easy viewing.

Use of the mattress display fixture 10 is as follows. The two support members 12*a*, 12*b* are stood on a floor or other support surface by arranging the floor engaging ends 61 and the support arms 60 thereof on the floor, with the interior side panels 44 of the support member 12*a*, 12*b* facing each other. The support members 12*a*, 12*b* are spaced from each other using the spacer member(s) 21. The shelves 14 are then installed by angling each shelf slightly upward and sliding the rear spacer 28 of each shelf 14 into the horizontal portion 64 of the cut-out 52. The shelf 14 is then rotated downward so that the rear spacer 28 moves upwardly into the vertical portion 66 of the cut-out 52 to a locked position. At the same time, the bottom surfaces of the leg portions 24 of the shelves 14 come to rest on top of and are supported by the upper surfaces 55 of the support beams 50, with the flanges 34 fitting within the slots 70 of the support beams.

When the shelves 14 are mounted in position, the rear spacer 28 of each shelf 14 is removably disposed within one of the cut-outs 52 in each of the support members 12*a*, 12*b* at the same vertical height. In addition, the lower surface of the leg portion 24 of the L-shaped member 22*a* is supported on the upper surface 55 of the support beam 50 of the support member 12*a* at that vertical height, and the lower surface of the leg portion 24 of the L-shaped member 22*b* is supported on the upper surface 55 of the support beam 50 of the support member 12*b* at that vertical height. In addition, as best seen in FIGS. 1 and 5, the rear end of each leg portion 24 of the L-shaped members 22*a*, 22*b* is disposed within the open interior space of the support members 12*a*, 12*b*, with the leg portions 24 fitting between the exterior side panel 46 and the interior side panel 44.

Optionally, the shelves 14 can be further secured to the support members 12*a*, 12*b* using mechanical fasteners or welding.

Once the display fixture 10 is assembled, a mattress 16 can then be disposed on each shelf 14.

Once the shelves 14 are installed, the rear spacer 28 of each shelf is detachably attached to a first portion (i.e. the interior side panel 44) of each of the support members 12*a*, 12*b*. In addition, the leg portions 24 of the L-shaped members 22*a* are supported on a second portion (i.e. the upper surfaces 55 of the support beams 50) of the support member 12*a*, and the leg portions 24 of the other L-shaped members 22*b* are supported on a second portion (i.e. the upper surfaces 55 of the support beams 50) of the support member 12*b*. The second portions (i.e. the upper surfaces 55 of the support beams 50) are positioned forwardly of the first portions (i.e. the interior side panel 44).

With the described construction, each shelf 14 is not directly supported by the support members 12*a*, 12*b* (or by any structure connected to the support members) forwardly of the support beams 50. The language "not directly supported" means that there is no structure that is directly attached to the shelf 14 forwardly of the support beams 50 that supports the shelf 14 in its operative or in-use position. Another of way of expressing this feature is that each shelf 14 is free of direct support forwardly of the support beams 50. For example, the support arms 60 may be considered as supporting each shelf 14. However, the support arms 60 are not directly attached to or in any way directly supporting any of the shelves 14 forwardly of the support beams 50. Therefore, each shelf 14 is not directly supported by, and is free of direct support from, the support arms 60 forwardly of the support beams 50.

The components of the display fixture 10 can be made of any material(s) that provide sufficient strength to perform the support and display functions of the fixture 10. Examples of suitable materials include plastics and metals such as steel and aluminum.

The described embodiment(s) may be embodied in other forms without departing from the spirit or novel characteristics thereof. The embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A mattress display fixture, comprising:

a pair of generally vertically extending support members spaced apart from one another; each of the generally vertically extending support members includes: an upper end and a lower end, an exterior side panel, an interior side panel, and a plurality of generally horizontally extending support beams, wherein the interior side panel is spaced from and extends generally parallel to the exterior side panel and defines a plurality of L-shaped cut-outs generally vertically spaced from one another, the plurality of generally horizontally extending support beams integrally formed therewith at positions forwardly of and spaced from the L-shaped cut-outs to extend inwardly from the exterior side panel, each of the L-shaped cut-outs including a horizontal portion extending rearwardly from a front edge of the interior side panel and a vertical portion extending upwardly from the horizontal portion opposite the front edge;

a plurality of shelves removably supported by the generally vertically extending support members and cantilever supported therefrom, and the shelves extend forwardly from the generally vertically extending support members;

each shelf includes a rear side removably disposed within a respective one of the L-shaped cut-outs, a front side opposite the rear side, and an intermediate portion between the rear side and the front side; and the intermediate portion of each shelf is supported by one of the generally horizontally extending support beams.

2. A mattress display fixture, comprising:

a pair of generally vertically extending support members spaced apart from one another; each of the generally vertically extending support members includes an upper end and a lower end, a plurality of cut-outs formed therein and generally vertically spaced from one another between the upper end and the lower end, and a plurality of generally horizontally extending support beams integrally formed therewith at positions forwardly of and spaced from the cut-outs;

a plurality of shelves removably supported by the generally vertically extending support members and cantilever supported therefrom, each shelf is of sufficient size to accommodate a mattress thereon, the shelves are generally vertically spaced apart from each other, and the shelves extend forwardly from the generally vertically extending support members;

wherein:

each shelf includes a rear side removably disposed within a respective one of the cut-outs, a front side opposite the rear side, and an intermediate portion between the rear side and the front side; and the intermediate portion of each shelf is supported by one of the generally horizontally extending support beams;

each shelf comprises:

a pair of generally L-shaped members that are spaced from one another, each generally L-shaped member includes a leg portion and a base portion, the generally L-shaped members are oriented so that the leg portions extend toward one another with the base portions extending generally vertically upward, the leg portions are positioned to support opposite lower sides of a mattress while the base portions limit side-to-side movements of the mattress when disposed on the shelf;

a plurality of spacers fixed to the generally L-shaped members and spacing the generally L-shaped members from one another, the spacers include a rear spacer that is removably disposed within one of the cut-outs, a front spacer, and an intermediate spacer between the rear spacer and the front spacer;

the rear spacer, the front spacer and the intermediate spacer are spaced from one another; and the spacers include upper surfaces that are approximately flush with upper surfaces of the leg portions.

3. The mattress display fixture of claim 1, wherein each of the generally vertically extending support members comprises:

a rear panel and a front panel spaced from the rear panel and being generally parallel thereto, the interior side panel extending forwardly from the rear panel toward the front panel, and the exterior side panel extending from the rear panel toward the front panel;

the front panel includes the plurality of generally horizontally extending support beams integrally formed therewith; and each of the generally horizontally extending support beams terminates at a free end opposite a corresponding exterior side panel and is positioned a distance away from the corresponding exterior side panel generally equal to a distance the interior side panel is positioned away from the corresponding exterior side panel.

4. The mattress display fixture of claim 2, further comprising a sign support fixed to and extending away from the base portion of at least two of the shelves adjacent to front sides thereof, the sign support extends generally vertically and presents a generally forwardly facing surface.

5. The mattress display fixture of claim 1, wherein the number of the generally horizontally extending support beams equals the number of the L-shaped cut-outs.

6. The mattress display fixture of claim 1, wherein each shelf is free of direct support forwardly of the generally horizontally extending support beams.

7. The mattress display fixture of claim 1, wherein when each shelf is maintained solely by the pair of generally vertically extending support members, each shelf slopes generally downwardly from the front side to the rear side thereof such that the front side is disposed at a vertical height greater than the rear side.

8. A display fixture configured to display mattresses, comprising:

a plurality of generally vertically spaced apart shelves each including two opposing side members and a plurality of spacers extending between the two opposing side members to maintain the two opposing side members spaced from each other;

a pair of generally vertical support means to which the shelves are removably supported and that support the shelves in a cantilever manner;

each generally vertical support means is a single-piece construction that includes a plurality of rear support structures and a plurality of forward support structures, each one of the forward support structures is positioned to cooperate with a respective one of the rear support structures thereby forming a plurality of support structure pairs, each support structure pair supporting one of the shelves; and for each support structure pair, one of the plurality of spacers of each shelf is removably disposed within the rear support structure, and each shelf includes an intermediate portion located forward of the rear portion that is removably supported by the forward support structure;

wherein:

each of the generally vertical support means comprises a rear panel, a front panel spaced from the rear panel and being generally parallel thereto, an interior side panel extending forwardly from the rear panel toward the front panel, and an exterior side panel extending between the rear panel and the front panel generally parallel to the interior side panel, the front panel includes the plurality of forward support structures integrally formed therewith, and the interior side panel includes the plurality of rear support structures formed therein.

9. The display fixture of claim 8, wherein each of the forward support structures includes an upper surface, and the intermediate portions of the shelves are supported by the upper surfaces.

10. A display fixture configured to display mattresses, comprising:

a plurality of generally vertically spaced apart shelves each including two opposing side members and a plurality of spacers extending between the two opposing side members to maintain the two opposing side members spaced from each other;

a pair of generally vertical support means to which the shelves are removably supported and that support the shelves in a cantilever manner;

each generally vertical support means is a single-piece construction that includes a plurality of rear support structures and a plurality of forward support structures, each one of the forward support structures is positioned to cooperate with a respective one of the rear support structures thereby forming a plurality of support structure pairs, each support structure pair supporting one of the shelves; and for each support structure pair, one of the plurality of spacers of each shelf is removably disposed within the rear support structure, and each shelf includes an intermediate portion located forward of the rear portion that is removably supported by the forward support structure;

wherein:

each of the two opposing side members includes a leg portion and a base portion, the members are oriented so that the leg portions extend toward one another with the base portions extending generally vertically upward, the leg portions are positioned to support opposite lower sides of a mattress while the base portions limit side-to-side movements of the mattress when disposed on the shelf, the leg portions are supported by the forward support structures, each of the plurality of spacers are fixed to the two opposing side members, the spacers include a rear spacer that is removably disposed within one of the rear support structures, a front spacer, and an intermediate spacer between the rear spacer and the front spacer, the rear spacer, the front spacer and the intermediate spacer are spaced from one another, and the spacers include upper surfaces that are approximately flush with upper surfaces of the leg portions.

11. The display fixture of claim 8, further comprising a sign support fixed to side, outwardly facing surfaces of the shelves, the sign support extends generally vertically and presents a generally forwardly facing surface.

12. The display fixture of claim 10, wherein a straight-line distance between the generally vertical support means is greater than a straight-line distance between the rear spacer and the front spacer of each shelf.

13. The display fixture of claim 8, wherein the number of the forward support structures equals the number of the rear support structures.

14. The display fixture of claim 8, wherein each shelf is free of direct support forwardly of the forward support structures by the generally vertical support means or by any structure connected to the generally vertical support means.

15. The mattress display fixture of claim 1, wherein each shelf comprises:

a pair of generally L-shaped members that are spaced from one another, each generally L-shaped member includes a leg portion and a base portion, the generally L-shaped members are oriented so that the leg portions extend toward one another with the base portions extending generally vertically upwardly, and the leg portion is disposed on one of the generally horizontally extending support beams of each of the pair of generally vertically extending supports;

a plurality of spacers fixed to the generally L-shaped members and spacing the generally L-shaped members from one another, the spacers include a rear spacer that is removably disposed within one of the L-shaped cut-outs of each of the pair of generally vertically extending support members, a front spacer, and an intermediate spacer between the rear spacer and the front spacer;

the rear spacer, the front spacer and the intermediate spacer are spaced from one another.

16. The mattress display fixture of claim 2, wherein each of the generally L-shaped members includes a flange extending downwardly from an end of the leg portion opposite the base portion, and each of the spacers is coupled with the flange such that the spacers include upper surfaces that are approximately flush with upper surfaces of the leg portions.

17. The mattress display fixture of claim 16, wherein each generally horizontally extending support beam defines a free end and an upwardly facing slot near the free end, and the flange is disposed within the upwardly facing slot.

18. The mattress display fixture of claim 2, wherein each generally horizontally extending support beam extends from a corresponding exterior panel a distance substantially equal to a distance a corresponding rear panel extends inwardly from the corresponding exterior panel.

* * * * *